US005905340A

United States Patent [19]

Karlotski et al.

[11] Patent Number: 5,905,340

[45] Date of Patent: May 18, 1999

[54] HIGH INTENSITY DISCHARGE LAMP WITH TREATED ELECTRODE

[75] Inventors: Rober J. Karlotski, Hillsboro, N.H.; Timothy L. Kelly, Boston; Galina Zilberstein, Chestnut Hill, both of Mass.

[73] Assignee: Osram Sylvania Inc., Danvers, Mass.

[21] Appl. No.: 08/971,702

[22] Filed: Nov. 17, 1997

[51] Int. Cl.[6] ..... H01J 17/04

[52] U.S. Cl. ..... 313/633; 313/623; 313/624; 313/626

[58] Field of Search ..... 313/491, 493, 313/574, 624, 623, 626, 633

[56] References Cited

U.S. PATENT DOCUMENTS 4,881,009 11/1989 Passmore ..... 313/631
5,461,277 10/1995 Gennip et al. ..... 313/623

*Primary Examiner*—Vip Patel
*Attorney, Agent, or Firm*—William E. Meyer

[57] ABSTRACT

A high intensity discharge lamp with a heat treated inner electrode rod has been found to form an advantageous crack pattern. As a result seal failures have been reduced and lamp life increased.

15 Claims, 2 Drawing Sheets

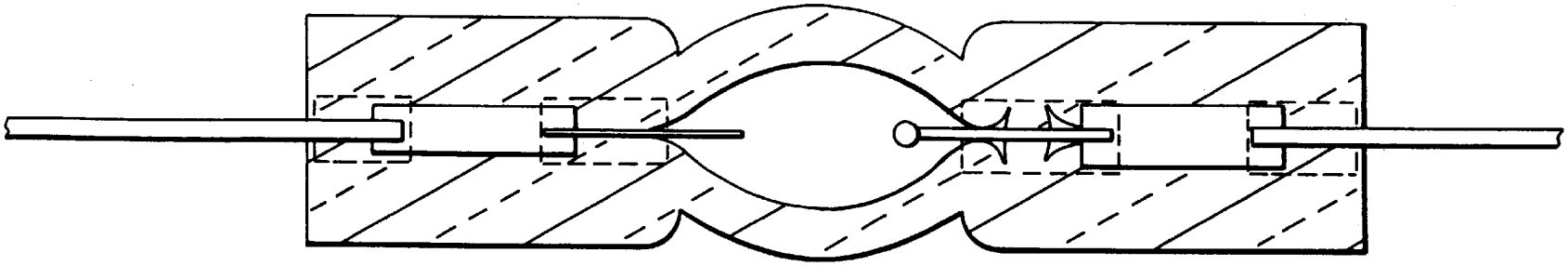
PRIOR ART
FIG. 1
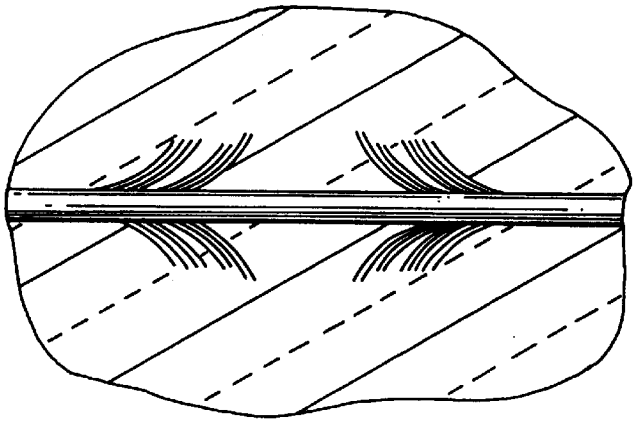
PRIOR ART FIG. 2

HIGH INTENSITY DISCHARGE LAMP WITH TREATED ELECTRODE

TECHNICAL FIELD

The invention relates to electric lamps and particularly to high intensity discharge electric lamps. More particularly the invention is concerned with the seal of an electrode in a high intensity discharge lamp.

BACKGROUND ART

Sealing a 35 watt vehicle HID lamp is difficult. The lamp is small, and the operating pressure may reach 60 atmospheres. The operating temperature of the press seals is considerably higher than that of a conventional metal halide lamp. It is known that thoriated tungsten can seal better with the quartz lamp envelope than can un-thoriated tungsten, and thoriated tungsten similarly has better electron emission characteristics. However, the thorium in the anode has been found to be transferred to the cathode during lamp operation. The transfer of thorium to the cathode causes an ever-changing thorium distribution on the cathode. The arc then wanders from place to place on the cathode as it seeks the point with the most emissive point. The wandering arc makes use of a thoriated electrode in an optical situation, such as a light source in a headlamp, difficult or unacceptable. There is then a need to improve lamp seals without using thoriated electrodes.

Normally, during cooling or lamp operation, the internal rod along its length cracks away from the envelope body, leaving a small crack between the internal rod and the envelope body. Fill materials can then migrate in the crack along the rod surface to where the rod and foil are welded. This process can be enhanced by electrical or mechanical pumping of the fill materials into the leading edge of the crack. The fill materials are then withdrawn from the internal lamp process. The fill materials can also react with the foil, the rod and the quartz to form compounds with still different thermal expansion characteristics. These materials can slowly leverage the crack to open farther, and by inching along in this fashion can cause the lamp seal and therefore the lamp to fail. Electric pumping along the rod surface acts to continually resupply materials for these reactions. Also the nonuniform adhesion to the internal rod can cause cracks which propagate from the initial condition along the internal rod to extend to the surface of the quartz press. These cracks then cause loss of hermeticity and lamp failure. There is then a need to block electrode crack extension and the resulting lamp failures.

Thoriated electrodes allowed a straight cleaving between the inner electrode and the adjacent quartz that deterred cracks from spreading to the surface resulting in lamps that leaked. So electing to use un-thoriated or bonding type tungsten electrodes, that were then normally processed, yielded cracks along the inner electrode rod that spread toward the surface. FIG. 1 shows a cross sectional view of a prior art high intensity discharge lamp made with a bonding type tungsten showing the cracking around the inner electrode rod. The lamp is a miniature HID lamp typical of an automotive HID lamp. FIG. 2 shows an artist's rendering of the cracking area of FIG. 1. The cracks are shown to spread away from the inner electrode rod in a fashion that leads to extension and then connection to the exterior surface. An unacceptable number of these lamps would go on to leak and fail. There was then a need for an HID lamp with a bonding type tungsten inner electrode with a seal that did not crack so as to leak. This is particularly true for very high pressure lamps, and lamps with very high thermal gradients cross their seals. Both of these factors exist in miniature HID lamps.

DISCLOSURE OF THE INVENTION

An improved arc discharge lamp may be formed from an envelope having a wall defining an exterior side, and defining an enclosed volume. A first electrode, having an exterior rod portion coupled to an intermediate seal foil that is in turn coupled to an inner rod of tungsten, is extended from the exterior side in a sealed fashion through the wall to be in contact with the enclosed volume. A portion of the inner tungsten rod is sealed to a jacket of envelope material, that may separate from the envelope by a narrow crack extending between the jacket and the envelope. A second electrode also extends from the exterior side in a sealed fashion through the wall to be in contact with the enclosed volume. A fill material is positioned in the enclosed volume to complete the lamp.

BRIEF DESCRIPTION OF THE DRAWINGS

FIG. 1 shows a cross sectional view of a high intensity discharge lamp (prior art).

FIG. 2 shows a detailed view of the cracking pattern in FIG. 1 (prior art)

BEST MODE FOR CARRYING OUT THE INVENTION

Figure 3:
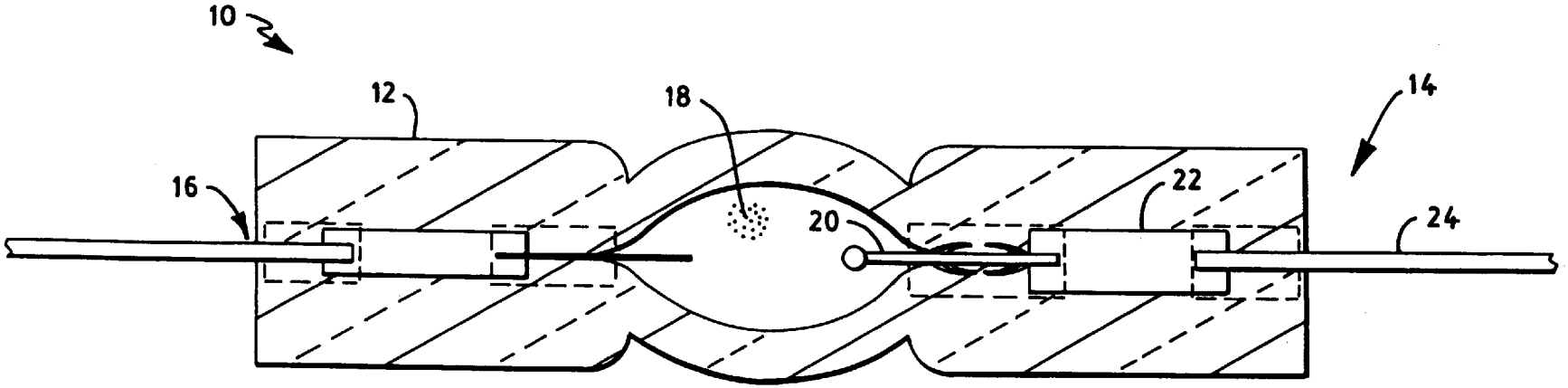
FIG. 3 shows a cross sectional view of a high intensity discharge lamp.

FIG. 3 shows a cross sectional view of a high intensity discharge lamp according to the preferred construction. The arc discharge lamp 10 is made from an envelope 12, a first electrode 14 (anode), a second electrode 16 (cathode) and a fill material 18.

The envelope 12 is made from a light transmissive material chosen to be press sealable. Quartz and hard glass are examples of the preferred material. The preferred envelope 12 has the form of a tube sealed at each end to define an intermediate enclosed volume.

The preferred first electrode 14 has an inner rod 20, and intermediate seal foil 22 and an exterior rod 24. The inner rod 20 is made of tungsten, or an alloy thereof as is generally known in the art. The preferred inner rod material is a tungsten that does not form a substantial amount of surface oxide glass when sealed to quartz or glass. A substantial amount of oxide glass would allow the inner rod 20 to separate from the envelope 12 along their interface. Pure tungsten is acceptable, as is a low doped alloy thereof such as a potassium doped or non-sag tungsten, where the doping is of a material and degree that the dopant does not enter the arc stream. For example, may be less than about 100 parts per million. Non-sag tungstens are generally known in the art of lamp making. Dopants, such as thoria, hafnia, scandia, rhenium or other elements that may form surface oxide glasses with the quartz, or may end up in the arc stream are not preferred. This is to avoid any arc wandering, and formation of any oxide glass. The pure, non-sag, and other tungsten alloys or doped tungstens that do not form surface oxide glasses when sealed to quartz or glass when sealed with quartz or glass then bond with it, and tend not to cleave from it during cooling. The tungstens that qualify hereunder shall be hereinafter refer to as "bonding type tungstens" for their ability to bond to quartz or glass, and not cleave from them.

The inner tungsten rod 20 is preferably heat treated with high heat, strong vacuum and over an extended period of time. The heat, vacuum and time in combination are sufficient that all or most of any residual material existing in or on the inner rod 20 that would otherwise be available to outgas during press sealing are exhausted. There is some tradeoff between the heat treatment temperature, the degree of vacuum, and the time of treatment so as to remove outgasing materials. The higher the heat treatment temperature, (less than the melting point of the inner rod 20) the less vacuum, or less treatment time is needed. Similarly the higher the vacuum, the lower the necessary heat treatment temperature, or the shorter the time of treatment. Also the longer the treatment time, the less the temperature and vacuum that may be needed. For convenience, it is generally easier to raise the temperature up to a point somewhat below the melting point of the inner tungsten rod 20. This enhances evaporation, or outgasing of other materials on or in the inner electrode rod 20. In general, the higher the vacuum that can be achieved the better. The total time for the heat and vacuum treatment is then shortened. In combination, the heat, the vacuum and the time of treatment allow all material that would otherwise be available to outgas during press sealing to be baked out and, and sucked away from the inner rod 20. Testing has found that high heat treatments of 2350 degrees Celsius in strong vacuum alone result in improved seals.

Practical experience has taught the Applicants that the heat treatment should be hot enough and long enough to induce partial or complete recrystalization of the inner rod 20. Partial recrystalization is felt to better than none, while complete recrystalization is felt to be the best. Recrystalization is a form of grain growth occurring in worked metals, and results in growth of some crystals at the expense of others along with the release residual stresses. The recrystalization of a tungsten wire (rod) depends on a variety of factors, but typically ranges between 2100 and 2400 degrees Celsius. For a wire or rod sample with a particular history of formation, there will be a characteristic temperature of recrystalization. It is believed that the high heat and increased internal mobility during grain growth and recrystalization causes most if not all of the outgasable materials to be driven off. The recrystalization temperature is likely the highest temperature experienced by the tungsten since formation, so recrystalization achieves the best removal of outgasable materials since formation. The recrystalization temperature is then something of a transition point in the process from being only somewhat effective to being substantially effective in creating inner electrode rods that work significantly better in the high pressure miniature HID lamps. Recrystalization reduces residual stresses, and may otherwise improve the electrode surface for a stress reduced or stress free bond with the envelope 12 material. Heat treating so as to recrystallize of the inner electrode rods 20 in a strong vacuum has yielded the best miniature HID lamp seals with a bonding type tungsten. This is not consistent with outgasing, since recrystalization yields the most through outgasing.

The heat treated inner rod 20 is then welded to the intermediate seal foil 22. The preferred, seal foil 22 maybe any of the familiar molybdenum type foils, as may be doped, shaped, or treated as is generally known in the art. The seal foil 22 may be similarly heat treated, but it is not believed to be necessary.

The seal foil 22 is then welded to the exterior rod 24. The exterior rod 24 may be made of tungsten, or other materials as is generally known in the art. The exterior rod 24 may be similarly heat treated, but it is not believed to be necessary. The preferred exterior rod 24 is made of nickel coated steel.

The second electrode 16 may be of any chosen form, but to make best use of the first electrode 14, the preferred second electrode 16 is made in a similar fashion as is the first electrode 14.

The fill material 18 may be any of the known lamp fill combinations. In the preferred embodiment, a metal halide formulation is chosen.

A first electrode 14 is then positioned in an envelope blank, commonly a section of a tube, so that after sealing the inner rod 20 will be in contact with what will become the defined enclosed volume. In the preferred construction, the first electrode is positioned to be an anode in a direct current (DC) discharge lamp. The envelope blank, at least in the region adjacent the seal foil 22 is heated to a plastic state, and pressed or vacuum sealed to seal with the seal foil 22. A portion of the heated envelope 12 material spreads over, and around the inner rod 20, and seals with the inner rod 20. Similarly, a portion of the heated envelope 12 material spreads over, and around the exterior rod 24, and seals with the exterior rod 24. As the heated envelope 12 material cools, for the most part, it remains in contact with the length of the inner tungsten rod 20. Stress relief cracking is then substantially transferred away from the interface between the rod 24 and the quartz envelope 12.

Figure 4:
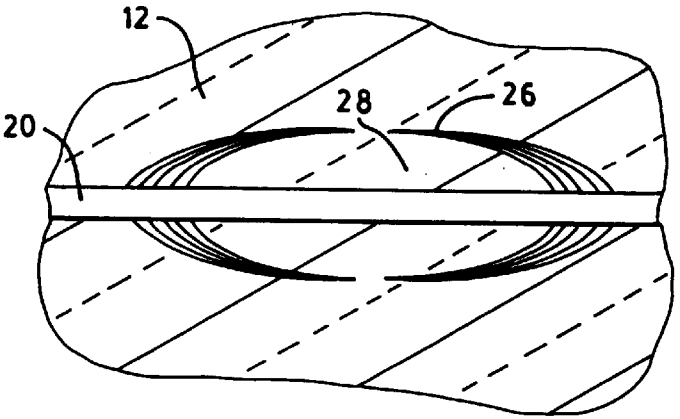
FIG. 4 shows a detailed view of the improved cracking pattern in FIG. 3.

FIG. 4 shows a detailed rendering of the improved cracking pattern for the lamp in FIG. 3. It should be understood that cracking of quartz is irregular and varies from sample to sample. Lamps made with the heat treated electrodes frequently have a telltale cracking pattern. Frequently, a crack 26 extends away from the inner rod 20, and may further extend along, but somewhat offset from, the inner rod 20. The crack 26 may then extend back to the inner rod 20, thereby defining an ellipsoidal, spherical or similar slug of material surrounding and attached to the inner rod 20 portion, that is sealed to the inner rod 20. The preferred crack 26 is then generally smooth. The preferred crack 26 generally leads back to the electrode rod 20 and is then cut off, tied off or otherwise internally self connected, and unlikely to extend to the exterior surface. The preferred crack is usually not splintered, or spiraling. The preferred crack pattern usually does not have a multiplicity of edges, or edges that lead in various directions and might extend towards the exterior surface. The preferred crack 26, such as one defining an ellipsoid, or spherical volume of envelope 12 material, then roughly defines an inner portion of the envelope 12 material sealed (bonded) around the inner rod 20, referred to as a jacket 28. Since the crack 26 defines a jacket 28 with a general form of a football (irregular albeit generally smooth and axially centered on the inner tungsten rod 20), it is called a football crack. On the opposite side of the crack 26 is an outer portion of the envelope 12 material, being the main body of the envelope 12. Alternatively the crack 26 might emerge along the inner wall of the enclosed volume, thereby forming a truncated football. In either case there is usually a segment of envelope material (jacket 28) bound to a length of the inner rod 20.

The fill material 18 is then positioned in the region that becomes the defined enclosed volume. The second electrode 16 is positioned in the envelope 12, the adjacent portion of the envelope 12 blank is heated, and while the fill material 18 is kept in the defined volume, for example by freezing it in place with liquid nitrogen. The envelope wall adjacent the second seal foil is then heated, and sealed with the second seal foil of the second electrode 16.

With the lamp 10 sealed, the inner rod 20 is then for the most part securely enclosed in a jacket 26 of the envelope 12 material. The fill material 18, during the lamp operation, may migrate into the crack 26 however, the interaction between the fill material 18 and the crack 26 walls is inert. There is then little or no electronic, or mechanical pumping, or similar surface interaction to promote the active migration of the fill material 18 into the offset crack 26, 30. Less fill material 18 is believed to enter the crack 26, and less is believed to move through the crack 26 to encounter the junction of the inner rod 20 and the seal foil 22. Less fill material 18 is then available to react with inner rod 20 and the seal foil 22. The seal then lasts longer enhancing the lamp's life of operation.

In the preferred embodiment the applicants used a non-sag tungsten, such as Sylvania NS-55, that has a phosphor doping of from 60 to 70 parts per million, for the inner rod. The inner rod was placed in a vacuum furnace, and heat treated under vacuum. In one method the electrode was heated to 2450 degrees Celsius, and held there for one hour. The whole length of the inner tungsten electrode was recrystallized. The preferred vacuum heat treatment schedule was for 2400 degrees Celsius for 30 minutes at about $5\times10^{-6}$ torr. The heat treatment was sufficient to cause a recrystalization and complete outgasing of the tungsten inner rod, whose microstructure is then stable at high temperature operation. The heat treatment was sufficient to drive off all outgasable components from the tungsten inner electrode. The heat treatment could be preformed in an inert atmosphere, such as a noble gas. If the heat treatment is done in hydrogen, the surface oxides are removed by chemical reaction forming water and tungsten. It is preferred to use a vacuum heat treatment; the surface oxides are then removed by physical evaporation.

Inner rods were made of non-sag tungstens (NS-55 and NS-86). One group was treated without recrystalization. A second group was held at 2400 degrees Celsius for 30 minutes at about $5\times10^{-6}$ Torr, and a third group were held at 2450 degrees Celsius for 1 minute at about $4.5\times10^{-4}$ Torr. Analysis showed the first group still had oxides groups on the surface, but the second and third groups did not. The first group retained a fibrous morphology, while the second group was fully recrystallized, and third group was partially recrystallized. In a similar test, the microhardness of as drawn rods were measured and found to average 596 (Knoop scale). Rods vacuum fired at 1600 degrees Celsius for 30 minutes averaged 531. Rods vacuum fired at 2400 degrees Celsius for 30 minutes averaged 390. Rods vacuum fired at 2450 degrees Celsius for 30 minutes, and others for 60 minutes were found to be fully recrystallized, with only slightly larger crystals in the longer fired rods. Some samples from the 30 minute firing showed 99 percent recrystalization with only some slight residual fibrous structure. Otherwise the morphology in both groups of the fully recrystallized tungsten showed large expanses of singe grain tungsten.

The heat treated inner rod was then welded to a molybdenum foil, and the foil was in turn welded to an exterior rod made of nickel coated steel. The lamp 10 was then assembled according to ordinary assembly procedures for miniature HID lamps, using known methods and materials. These lamps typically have envelopes about 3 centimeters long and 5 millimeter in diameter, and have metal halide fills with more than 5 atmospheres (cold) of xenon. Here about 8 atmospheres (cold) of xenon was used giving a hot operating pressure of about 60 atmospheres.

In examining lamps after sealing, a telltale crack pattern was frequently seen. The inner tungsten rod was not cracked away from the envelope material along the interface between the inner rod and the envelope. Instead, the inner rod had a jacket of attached envelope material clinging to the length of the inner electrode rods. The crack extended around the slug of envelope material forming the jacket. About seventy or eighty (70%–80%) of the lamps made with the heat treated electrode had such a football crack pattern. About twenty to thirty percent (20%–30%) of the best looking lamps appeared to have no football crack, but it is believed that in fact the football crack is present, but it has a very shallow angle with respect to the inner electrode rod. It is then just a very thin football crack, amounting to a narrow sheathing of a portion of the inner electrode rod. The lamps with narrow football cracks look better, but do not appear to test better than lamps with fuller football cracks.

The heat treating then controls the envelope crack to have a regular form that, except for its two ends, is offset from the inner electrode rod. First, the crack does not extend into the foil region. Second the crack is self contained and does not extend to the envelope surface. Since the crack is offset from the electrode, there is reduced chemical interaction with the rod. Less material can then be lost from the lamp process. Electric pumping of the fill materials along the rod surface is also stopped. The region available for chemical interaction with the internal rod is greatly reduced if not eliminated.

As a result of the heat treated electrodes, anode crack failures have been greatly reduced. In making thousands of lamps with heat treated anodes, there has been no known anode seal failure. There has been only one suspect lamp, but that lamp had additional defects. Some lamps have a crack extending from the exterior end edge of the inner electrode, but this is at the cold end of the rod. There is less thermal expansion stress there, and it is difficult for fill materials to migrate to reach such a deeply situated crack. Overall, as a result, a significantly higher percentage of lamps under production now reach completion, substantially reducing waste. It is expected that average lamp life will similarly improve. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An arc discharge lamp electrode for sealing to a lamp envelope comprising:

an electrode having an inner tungsten portion, made of a bonding type tungsten, having no outgasable components at least in the portion of the electrode adjacent the lamp envelope.

2. An arc discharge lamp electrode for sealing to a lamp envelope comprising:

an electrode having an inner tungsten portion, made of a bonding type tungsten, heat treated to recrystallize the tungsten surface at least in the portion of the electrode adjacent the lamp envelope.

3. An arc discharge lamp comprising a) an envelope having a wall defining an exterior side, and defining an enclosed volume, b) a first electrode, having an exterior rod portion coupled to an intermediate seal foil that is in turn coupled to an inner tungsten rod, made of a bonding type tungsten, the electrode extending from the exterior side in a sealed fashion through the wall to be in contact with the enclosed volume, the inner tungsten rod having no outgasable components at least in the portion of the electrode adjacent the envelope, c) a second electrode, extending from the exterior side in a sealed fashion through the wall to be in contact with the enclosed volume, and d) a fill material positioned in the enclosed volume.

4. The arc discharge lamp in claim 3, wherein the inner tungsten rod has been heat treated to recrystallize the tungsten surface at least in the portion of the electrode adjacent the envelope.

5. The arc discharge lamp in claim 4, wherein the inner tungsten rod has been heat treated in vacuum.

6. An arc discharge lamp comprising a) an envelope having a wall defining an exterior side, and defining an enclosed volume, b) a first electrode, having an exterior rod portion coupled to an intermediate seal foil that is in turn coupled to an inner tungsten rod, made of a bonding type tungsten, the electrode extending from the exterior side in a seated fashion through the wall to be in contact with the enclosed volume, a portion of the inner tungsten rod being sealed to a jacket of quartz envelope material, separated from the envelope by a narrow crack extending between the jacket and the envelope, c) a second electrode, extending from the exterior side in a sealed fashion through the wall to be in contact with the enclosed volume, and d) a fill material positioned in the enclosed volume.

7. The lamp in claim 6, wherein the inner electrode has been heat treated to substantially out gas all outgasable material.

8. The lamp in claim 6, wherein the inner electrode has been heat treated to cause recrystalization of the electrode rod.

9. A method of making an arc discharge lamp having an envelope, a first electrode, a second electrode and a fill material, comprising the steps of:

a) fabricating the first tungsten electrode, b) heat treating the first tungsten electrode at sufficiently long time, at a sufficiently high temperature, and at a sufficiently strong vacuum to cause an out gassing of substantially all outgasable material, c) sealing the envelope to the first electrode, including the portion having no outgasable components, and d) filling and sealing the lamp by otherwise known methods.

10. The method in claim 9 wherein heat treating time and temperature of the electrode rod are sufficient to cause recrystalization of the tungsten surface of the electrode rod.

11. An arc discharge lamp electrode comprising a drawn tungsten wire rod having, having a region for molten sealing to a lamp envelope, the rod having a recrystallized metallographic state at least in the region to be sealed to the lamp envelope.

12. The electrode in claim 11, wherein the electrode is composed of a bonding type tungsten.

13. An electric lamp comprising a) an envelope having a wall defining an enclosed volume, the envelope formed from an envelope material of hard glass, b) a fill material enclosed in the enclosed volume, c) a first electrode having an external end exposed in part to the exterior, an intermediate seal section sealed to the envelope material, and an internal end extending at least in part into the enclosed volume, the internal end being formed from a bonding type tungsten and sealed to a section of envelope material with substantially no oxide glass material therebetween, the envelope material extending axially along, radially away from the internal end, with a separating crack formed between the section of envelop material, and the remaining envelop; and d) a second electrode sealed with the envelope to provide electrical connection from the envelope exterior to the enclosed volume.

14. The lamp in claim 13, wherein the inner electrode has been heat treated to substantially out gas all outgasable material.

15. The lamp in claim 13, wherein the inner electrode has been heat treated to cause recrystalization of the electrode rod.

* * * * *